US005294129A

United States Patent [19]

Brown

[11] Patent Number: 5,294,129

[45] Date of Patent: Mar. 15, 1994

[54] THROW TOY WITH TWO SPONGY WEIGHTS AND ENERGY STORING STRETCHY WEB

[76] Inventor: Paul J. Brown, 38 Birchdale La., Port Washington, N.Y. 11050

[21] Appl. No.: 977,069

[22] Filed: Nov. 16, 1992

[51] Int. Cl.[5] ..... A63B 65/00; A63B 67/00

[52] U.S. Cl. ..... 273/327; 273/343

[58] Field of Search ..... 273/428, 318, 327, 341, 273/343, 67 B, 67 R, 424; 446/236, 486

[56] References Cited

U.S. PATENT DOCUMENTS

| | | | |
|---|---|---|---|
| 442,675 | 12/1890 | Wilcox | 273/327 |
| 2,002,631 | 5/1935 | Fiondella | 273/428 |
| 2,436,174 | 2/1948 | Myers | 273/327 X |
| 3,026,110 | 3/1962 | Hess et al. | 273/424 X |
| 3,357,705 | 12/1967 | Blanchard | 273/428 X |
| 3,814,428 | 6/1974 | Foley | 273/343 |
| 5,165,694 | 11/1992 | Kraushaar | 273/343 |

*Primary Examiner*—Mickey Yu
*Attorney, Agent, or Firm*—Notaro & Michalos

[57] ABSTRACT

A throw toy includes a pair of soft, spongy weights separated by a flat flexible and stretchy web. Upper and lower hour-glass shaped layers are fastened around their periphery around the pair of spaced apart weights to form the web and enclose the weights to complete the throw toy. A sickle-shaped throwing member can be used with the throw toy.

14 Claims, 3 Drawing Sheets

FIG. 3
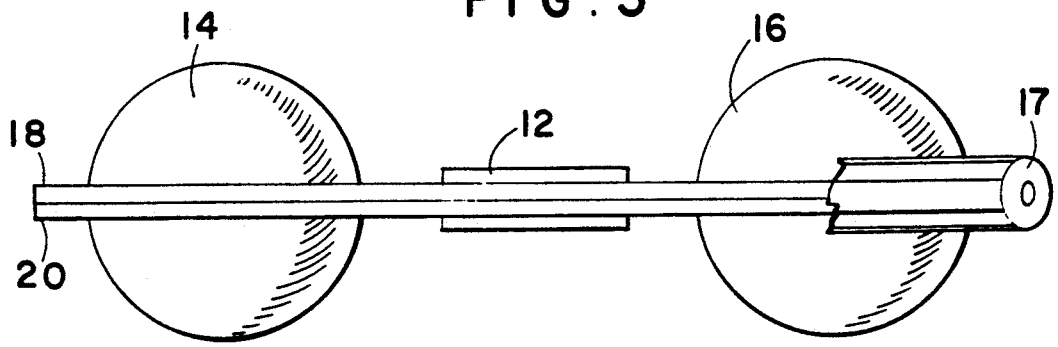
FIG. 4
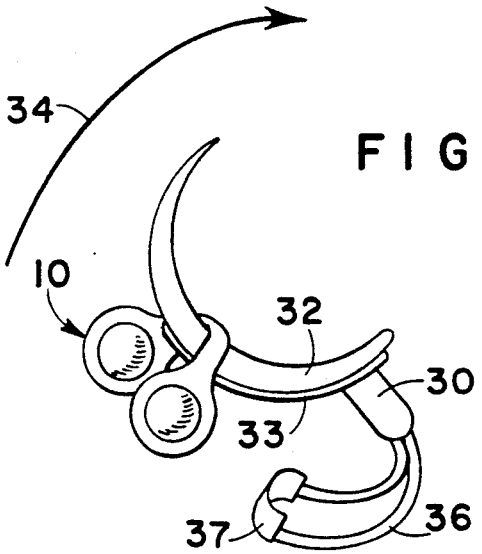
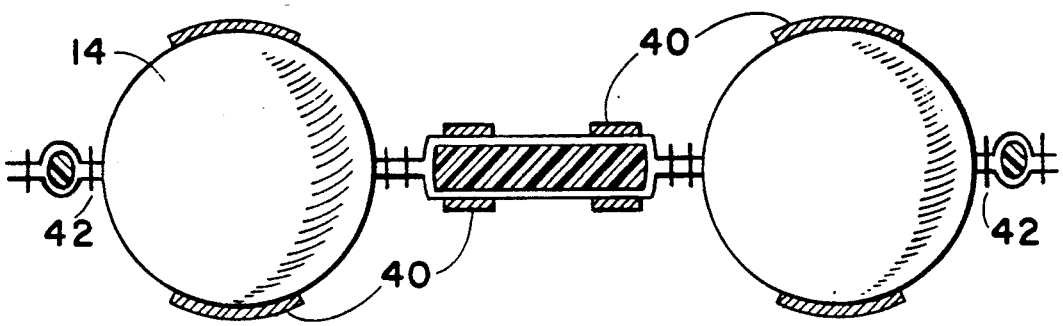
FIG. 5

FIG. 6
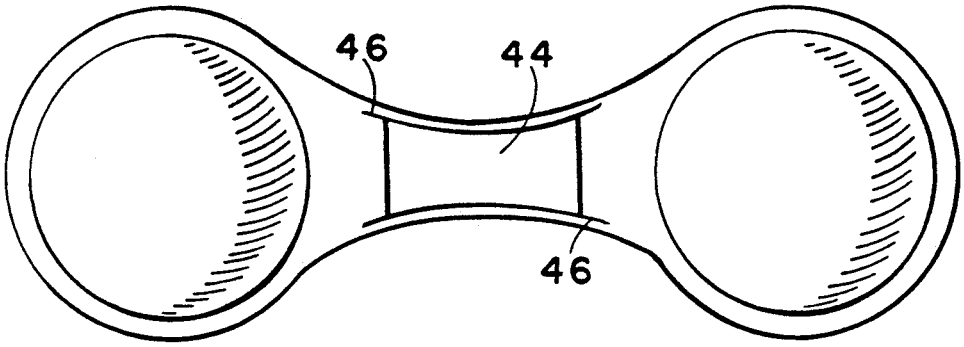
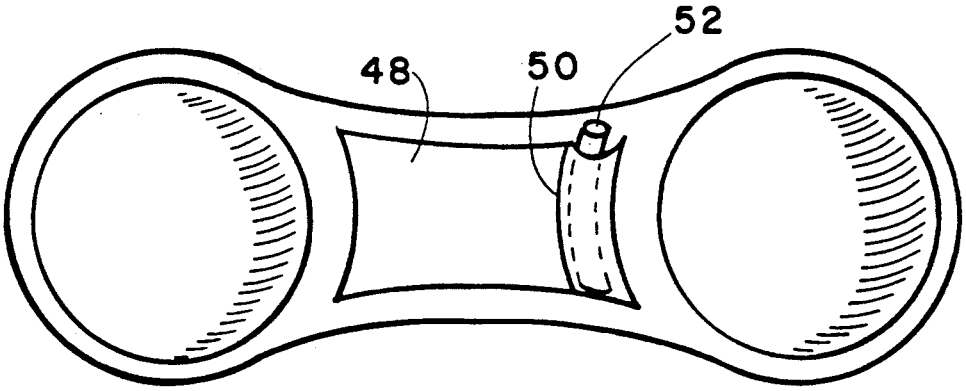
FIG. 7

THROW TOY WITH TWO SPONGY WEIGHTS AND ENERGY STORING STRETCHY WEB

FIELD AND BACKGROUND OF THE INVENTION

The present invention relates in general to toys that are meant to be thrown through the air and caught, and in particularly to a new and useful throw toy having a pair of spaced apart spongy weights with a flexible web therebetween which has a unique throwing, flying and catching characteristic.

A wide variety of throw toys are known, including a rigid barbell shaped throw toy such as the projectile disclosed in U.S. Pat. Nos. 2,002,631 and 3,357,705. A bouncing toy comprising one large and one small ball connected to each other by a rigid rod is also disclosed in U.S. Pat. No. 3,114,550.

An exercise game utilizing a specialized projectile is also disclosed in U.S. Pat. No. 2,408,160. The projectile comprises a pair of balls connected by a flexible metal strap which can be tossed in the air, for example, by engaging the strap around a users foot and kicking the projectile into the air. The metal strap makes it somewhat awkward and dangerous to catch the projectile.

U.S. Pat. No. 4,040,619 discloses an hour-glass shaped spongy squeeze toy comprising two oval enlargements connected together by a reduced diameter neck.

U.S. Pat. Nos. 4,944,363 and 5,026,054 disclose toy balls containing a spongy gel with multiple covering layers. The ball has a unique weighted feel and resilient characteristic that can be utilized as weights for the present invention.

SUMMARY OF THE INVENTION

The present invention comprises a throw toy or projectile whose main purpose is to provide recreational enjoyment and/or physical exercise to the user. Its main function is to be thrown in a certain way so as to utilize the stretchable expansion qualities of its material and to achieve maximum propulsion. It can be tossed by hand or in conjunction with a throwing apparatus forming another feature of the present invention. The projectile can also be juggled with, and caught after successful bounces off the knee, foot or the throwing apparatus.

Structurally, the invention comprises a pair of spongy weights connected to each other by overlying upper and lower flexible fabric covers that produce a flexible, stretchy web between the spongy weights. The projectile can be thrown underhanded, straight up into the air, end over end, in boomerang style, to be caught by the thrower as it returns to earth. The throwing toy can be caught by hand because of its soft, spongy characteristics, and preferably at the center or web between the weights. A high friction, e.g., cross hatched textured area can be provided on upper and lower surfaces of the web to further facilitate catching. The soft spongy weights and soft flexible coverings allow the projectile to be thrown and caught in any game utilizing projectiles without injury or danger to the players.

Accordingly, an object of the present invention is to provide a throw toy comprising a pair of spaced apart spongy weights and a flat stretchy and flexible web connected between the spongy weights.

A further object of the present invention is to provide a throw toy assembly which includes the throw toy and a sickle shaped throwing member for engaging the web, and a handle connected to the throwing member for swinging the throwing member through an arc to throw the throw toy.

A still further object of the invention is to provide a throw toy which comprises upper and lower hour-glass shaped layers which are sealed to each other over the spaced apart spongy weights to form the web and complete the throwing toy.

A still further object of the invention is to provide a unique spongy throw toy which has interesting throwing, flight and catching characteristics, and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 3 is a side elevational view with a portion cut away illustrating the embodiment of FIG. 2;

FIG. 4 is a throw toy assembly including a throw toy and a throwing member in accordance with the present invention;

FIG. 5 is a sectional view of another embodiment of the invention;

FIG. 6 is a plan view of another embodiment of the invention; and

FIG. 7 is a plan view of a still further embodiment of the invention.

DESCRIPTION OF THE PREFERRED EMBODIMENTS

Figure 1:
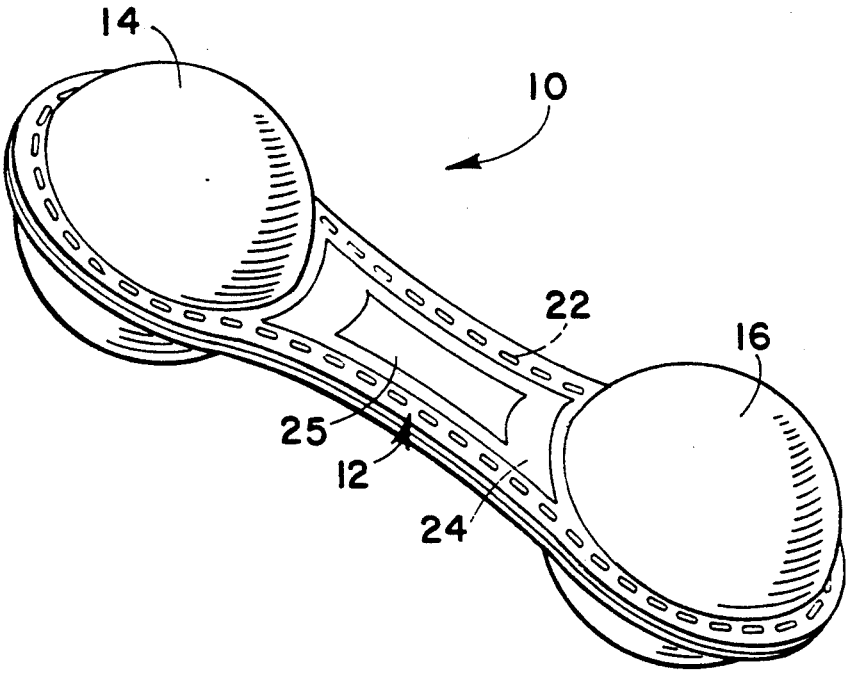
FIG. 1 is a perspective view of one embodiment of the invention.

Referring to the drawings, the invention embodied therein comprises a soft floppy throw toy generally designated 10 having a flexible flat intermediate web portion 12 with opposite ends to which spongy, silicon gel filled balls 14 and 16 are attached to produce a flattened, soft, floppy yet heavy bar-bell or hour-glass type structure. Each silicon gel ball maybe covered by a fabric and then encased between upper and lower neoprene or other flexible layers 18 and 20 which are sewn, sealed glued or otherwise connected together by a seam 22, to capture the two silicon balls. Neoprene is like the fabric used in wet-suits. A thin latex layer 24 is sewn onto the top and bottom of the central web 12 or may be between the layers of the web. A heavier panel or cross hatched latex reinforcement 25 is attached over the latex layers 24 or on or between the layers of the web. This provides some resistance to flexibility at the center of the throw toy and a high friction target area to ease catching of the toy.

FIG. 4 illustrates a structure for throwing the throw toy 10 that comprises a handle 30 to which a thin scoop or sickle shaped portion 32 in connected. The throw toy 10 is thrown by wrapping its web 12 around the scoop as shown, and then swinging handle 30 and sickle 32 along an arc 34. The rather flat throw toy tends to straighten out, spin and tumble, and can be caught without danger or injury because of its soft floppy nature.

FIG. 4 also shows a curved member 33 engaged along approximately one-half of the length of the sickle shaped more flexible member 32 for partially reinforcing the member to add dynamics to the throwing operation.

The throwing member in FIG. 4 may also include a bent tubular cage 36 forming a curved U-shape having a sling 37. The user places their hand through the U-shaped cage 36 with the sling 37 engaged around the forearm while handle 30 is grasped, to reinforce the wrist and help in the throwing operation.

Figure 2:
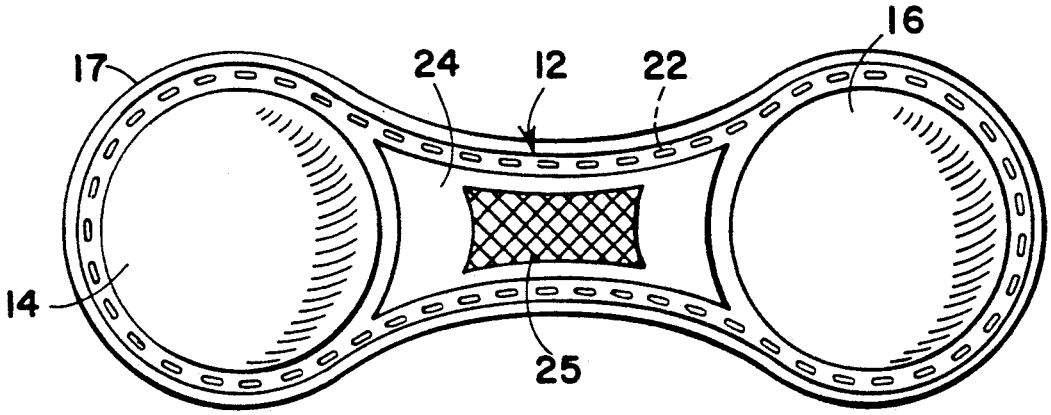
FIG. 2 is a top plan view of a different embodiment of the invention.

A wide variety of materials can be used for the pair of hour-glass flexible sheets forming the upper and lower layers 18, 20 of the toy. Instead of a sewn seam 22, other fastening mechanisms can be used such as heat sealing, gluing and the like. FIGS. 2 and 3 also show an embodiment of the invention which includes a tubular border 17 around the edge of the toy, made for example by split surgical tubing to protect the outer edges of the fabric or flexible sheet material. The tube may be made of latex, flexible plastic or other resilient flexible material and helps in the flying characteristics and the ease and comfort of catching the toy.

The reinforced area 25 may be cross hatched to increase frictional characteristics of the web to aid in catching. The area also provides a clear target for the catcher to focus on for catching the throw toy as it is flying through the air. It thus serves as a marking on the web to facilitate catching.

FIG. 5 is a sectional view showing a seam 42 connecting the upper and lower hour-glass sheets, with an extra layer in the web and an element in the boarder area of the toy. Additional areas 40 are attached to the outer surface of the toy.

FIG. 6 shows an embodiment of the invention with flexible area 44 in the web bounded by two flexible elements 46, 46 on opposite sides of the area 44.

FIG. 7 shows a layer 48 over the web having a pocket 50 for receiving an element 52.

While the specific embodiments of the invention have been shown and described in detail to illustrate the application of the principles of the invention, it will be understood that the invention may be embodied otherwise without departing from such principles.

What is claimed is:

1. A throw toy comprising:

a pair of spaced apart spongy weights;

a flat stretchy and flexible web connected between the spongy weight;

a pair of hour-glass shaped flexible layers fastened above and below the pair of spaced apart spongy weights to enclose the weights and form the web, the layers having an outer border;

a seam around the outer border for connecting the layers to each other; and at least one additional layer of material on the web for adding stretch and flexibility characteristics to the web.

2. A throw toy according to claim 1, including a pocket in the at least one additional layer of material, adapted for receiving an element to be held on the web.

3. A throw toy according to claim 1, including markings on the web for facilitating catching of the throw toy.

4. A throw toy according to claim 3, wherein the markings comprise a cross hatched layer attached on the at least one.

5. A throw toy according to claim 4, wherein the cross-hatched layer is smaller than the at least one additional layer of material on the web, the at least one additional layer of material being smaller than the web.

6. A throw toy according to claim 1, including a flexible resilient tubular member engaged over the border and around the throw toy.

7. A throw toy according to claim 6, including means for marking the web for facilitating catching of the throw toy.

8. A throw toy according to claim 6 including markings comprising a cross hatched layer attached on the web.

9. A throw toy according to claim 8, wherein the at least one additional layer of material on the web is smaller than the web, the cross-hatched layer being on the at least one additional layer of material and being smaller than the at least one additional layer of material.

10. A throw toy assembly comprising:

a pair of spaced apart spongy weights;

a flat stretchy and flexible web connected between the spongy weights;

a pair of hour-glass shaped flexible layers fastened above and below the pair of spaced apart spongy weights to enclose the weights and from the web, the layers having an outer border;

a seam around the outer border for connecting the layers to each other;

at least one additional layer of material on the web for adding stretch and flexibility characteristics to the web; and a throwing member having a sickle-shaped portion for engagement on the web, to facilitate throwing of the throw toy, the throwing member including a handle connected to the sickle-shaped portion.

11. An assembly according to claim 10, including a reinforcing member extending partly along a back of said sickle shaped portion.

12. An assembly according to claim 10, including means for marking the web for facilitating catching of the throw toy.

13. An assembly according to claim 12, including markings comprising a cross hatched layer attached on the web.

14. An assembly according to claim 13, including a flexible resilient tubular member engaged over the border and around the throw toy.

* * * * *